US006375402B1

(12) United States Patent
Hertelendi et al.

(10) Patent No.: US 6,375,402 B1
(45) Date of Patent: Apr. 23, 2002

(54) APPARATUS FOR UNLOADING RAILS

(75) Inventors: Josef Hertelendi, Freilassing (DE); Dieter Weiss, Salzburg (AT)

(73) Assignees: Robel Bahnbaumaschinen GmbH, Freilassing (DE); Voest-Alpine Schienen GmbH & Co. KG, Loeben (AT)

( * ) Notice: Subject to any disclaimer, the term of this patent is extended or adjusted under 35 U.S.C. 154(b) by 0 days.

(21) Appl. No.: 09/500,873

(22) Filed: Feb. 9, 2000

(30) Foreign Application Priority Data

Feb. 12, 1999 (AT) ..... 205/99

(51) Int. Cl.[7] ..... E01B 29/17

(52) U.S. Cl. ..... 414/373; 104/2; 104/7.2; 414/340; 414/389; 414/532; 414/535; 414/572

(58) Field of Search ..... 414/572, 559, 414/501, 585, 539, 389, 340, 343, 434, 338, 345, 529, 531, 532, 373, 535, 494, 745.4, 745.5; 104/2, 4, 7.2

(56) References Cited

U.S. PATENT DOCUMENTS

| | | | | | |
|---|---|---|---|---|---|
| 1,329,392 | A | * | 2/1920 | Ford | 414/389 X |
| 3,199,462 | A | * | 8/1965 | Hooker | 104/2 |
| 3,635,164 | A | * | 1/1972 | Patton | 104/2 X |
| 3,744,259 | A | * | 7/1973 | Wagley | 414/745.5 X |
| 3,756,426 | A | * | 9/1973 | Young | 414/745.5 |
| 5,469,791 | A | * | 11/1995 | Theurer et al. | 104/2 X |
| 5,762,464 | A | * | 6/1998 | Hertelendi | 414/338 X |
| 5,961,271 | A | * | 10/1999 | Theurer et al. | 414/339 |

FOREIGN PATENT DOCUMENTS

| | | |
|---|---|---|
| DE | 295 01 077 | 4/1995 |
| DE | 297 01 016 | 4/1997 |
| DE | 297 12 216 | 11/1997 |
| EP | 0 699 802 | 7/1995 |
| FR | 2 399 346 | 3/1979 |

* cited by examiner

*Primary Examiner*—Frank E. Werner
(74) *Attorney, Agent, or Firm*—Collard & Roe, P.C.

(57) ABSTRACT

An apparatus for unloading rails from a freight car on which the rails are arrayed to extend in a longitudinal direction of the freight car comprises a track-bound car, and a rail guiding unit positioned at each car end. Each rail guiding unit comprises a pair of rail guide heads having guide rollers for centering a respective one of the rails therebetween. The rail guide heads of a first rail guiding unit are positioned at one of the car ends and are displaceable in a horizontal plane perpendicularly to the longitudinal direction, and drives are provided for vertically adjusting the rail guide heads of the first rail guiding unit.

7 Claims, 2 Drawing Sheets

APPARATUS FOR UNLOADING RAILS

BACKGROUND OF THE INVENTION

1. Field of the Invention

The present invention relates to an apparatus for unloading rails from a freight car on which the rails are arrayed to extend in a longitudinal direction of the freight car, which comprises rail guide heads for guiding and centering the rails drawn off the freight car.

2. Description of the Prior Art

German utility model No. 295 01 077 discloses a rail unloading apparatus comprising rail guide heads mounted on the rear end of a freight car transporting the rails and cars pulled along by a rope, which run on the track and serve to support the rails drawn off the freight car. Long rails cannot be drawn off the freight car with this apparatus because the required pulling forces are too great.

Other, structurally complex apparatus of this general type are known from German utility models Nos. 297 01 016 and 297 124 216.

SUMMARY OF THE INVENTION

It is the primary object of this invention to provide an apparatus of the first-indicated type which enables even long rails requiring high pulling forces to be unloaded from freight cars while having a relatively simple structure.

The above and other objects are accomplished according to the invention with an apparatus for unloading rails from a freight car on which the rails are arrayed to extend in a longitudinal direction of the freight car, which comprises a track-bound car extending in the longitudinal direction and having opposite ends, and a rail guiding unit positioned at each one of the car ends. Each rail guiding unit comprises a pair of rail guide heads having guide rollers for centering a respective one of the rails therebetween. The rail guide heads of a first one of the rail guiding units are positioned at one of the car ends and are displaceable in a horizontal plane perpendicularly to the longitudinal direction, and drives are provided for vertically adjusting the rail guide heads of the first rail guiding unit.

The arrangement of two rail guiding units spaced from each other at opposite ends of the car makes possible the very economical use of a regulation flat car widely used in rail freight transportation, the retrofitting of the car for unloading the rails being fairly minimal. In addition, the two rail guiding units spaced apart in the longitudinal direction assure a stable guidance of the rails pulled off the freight car and prevent them from tilting.

BRIEF DESCRIPTION OF THE DRAWING

The above and other objects, advantages and features of the present invention will become more apparent from the following detailed description of a now preferred embodiment thereof, taken in conjunction with the accompanying, partly schematic drawing wherein.

DETAILED DESCRIPTION OF THE PREFERRED EMBODIMENT

Figure 1:
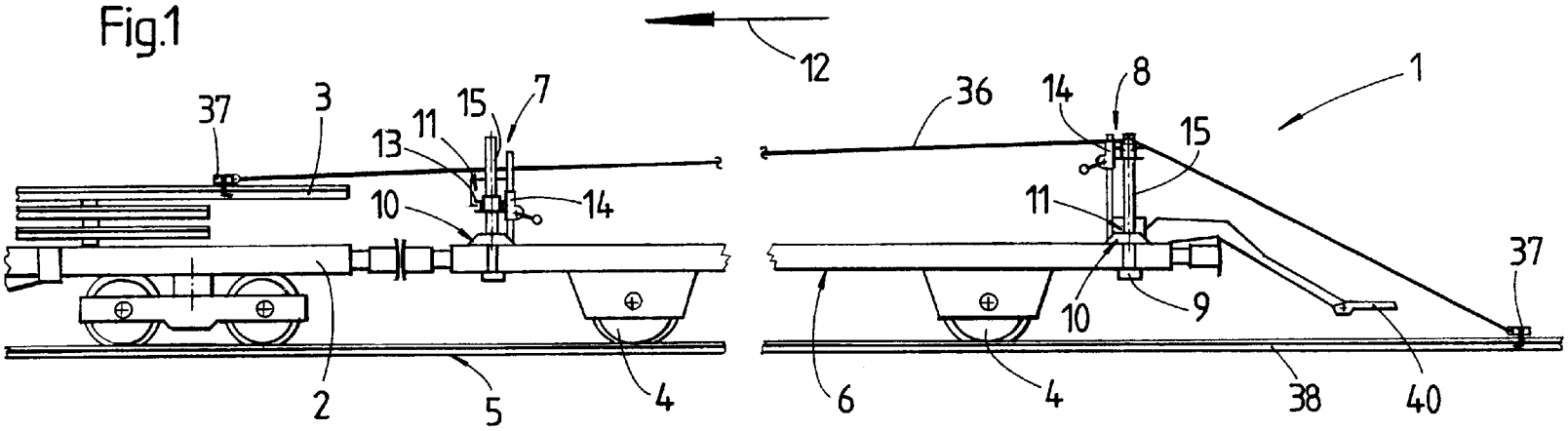
FIG. 1 is a side elevational view of the apparatus comprising a track-bound flat car on which the rail guiding units are detachably mounted.

The drawing shows apparatus 1 for unloading rails 3 from a freight car 2 on which the rails are arrayed to extend in a longitudinal direction of the freight car. It comprises track-bound car 6 extending in the longitudinal direction and coupled to the freight car. Car 6 is preferably a standard flat railroad car supported by undercarriages 4 on a track comprised of rails 38 fastened to ties 5. Such a car may readily be retrofitted with rail guiding units 7, 8 positioned at the opposite ends of the car. If connecting means 9 are provided for detachably mounting rail guiding units 7, 8 on car 6, the car may be used for regular freight transport when the rail guiding units are detached.

Each rail guiding unit 7, 8 comprises a pair of rail guide heads 11 having guide rollers 22 for centering a respective one of the rails 3 therebetween. Common frame 10 carries rail guiding heads 11 of each rail guiding unit 7, 8. The pair of rail guiding heads is arranged in a horizontal plane and spaced from each other in a direction extending perpendicularly to the longitudinal direction.

Rail guide heads 11 of a first rail guiding unit 7 positioned at the front car end relative to the operating direction indicated by arrows 12 are displaceable in a horizontal plane perpendicularly to the longitudinal direction. The rail guide heads are displaceably carried by carrier beam 13 extending in the horizontal plane perpendicularly to the longitudinal direction, and drives, such as winches 14, vertically adjust the carrier beam. Carrier frame 10 is comprised of two transversely spaced, vertical guide columns 15 connected by the carrier beam.

Figure 3:
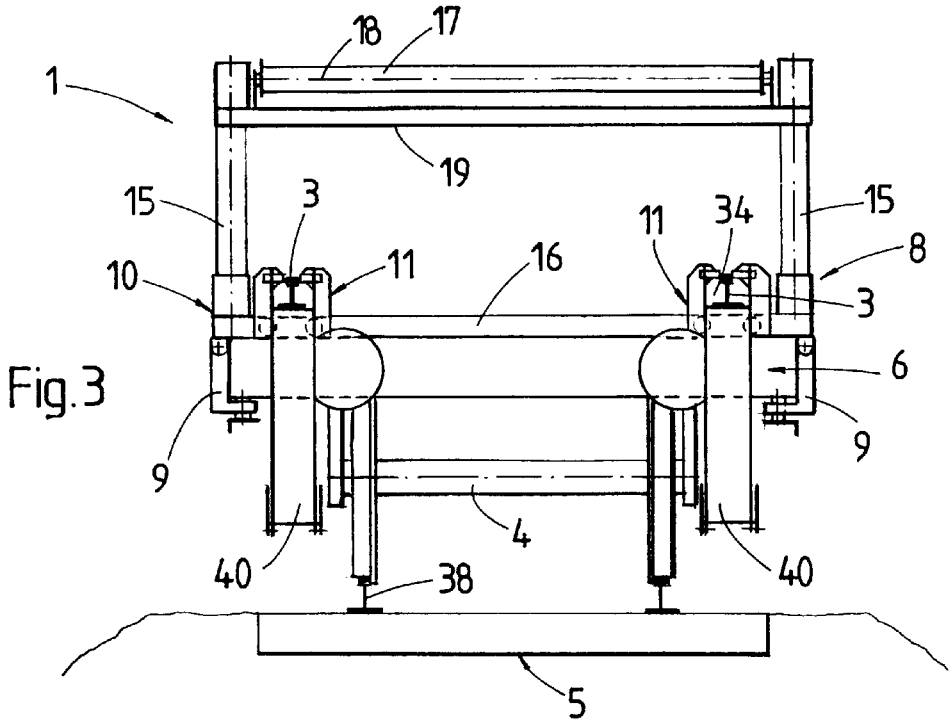
FIG. 3 is an end view of the apparatus, seen in the direction of arrow 12.
Figure 4:
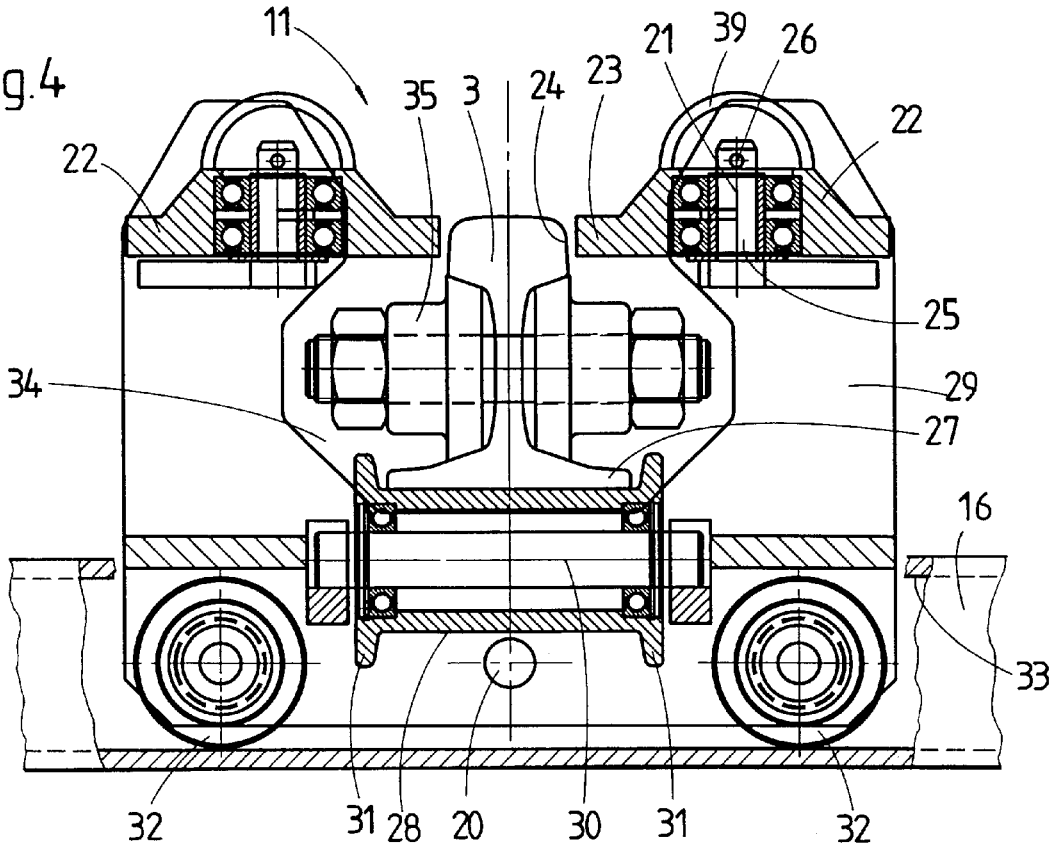
FIG. 4 is an enlarged cross sectional view of a rail guiding head.

Rail guide heads 11 of second rail guiding unit 8 positioned at the opposite car end are displaceable in a horizontal plane perpendicularly to the longitudinal direction on carrier beam 16, as best shown in FIG. 4. Stop 20 on the carrier beam stops the transverse displacement of the rail guide head. A rope guiding roll 17 is mounted above rail guiding unit 8, the rope guiding roll being rotatably mounted on carrier frame 19 and extending horizontally and perpendicularly to the longitudinal direction over the rail guide heads. Carrier frame 19 is vertically adjustably mounted on vertical guide columns 15 (see FIG. 3) and may be vertically adjusted by suitable drives, such as winches (not shown in FIG. 3 to avoid crowding).

As shown in FIG. 4, rail guiding head 11 comprises a carrier body 29 whereon the pair of guide rollers 22 is detachably mounted, the guide rollers being rotatable about vertical axes 21. Each guide roller has a flange 23 for engaging rail head 24 of a rail 3 being guided between the guide rollers as it is unloaded from freight car 2. Each guide roller is rotatably mounted on vertical pin 25 and is securerd against lifting off the pin by a safety bolt 26. A base roller 28 is also rotatably mounted on carrier body 29 for supporting base 27 of rail 3 The base roller is rotatable about axis 30 extending in a horizontal plane perpendicularly to the longitudinal direction and has flange 31 at each end for centering the rail base. Guide rollers 32 displaceably support rail guide head 11 in guide track 33 of carrier beam 16, and stop 20 enables the displacement to be blocked. Carrier body 29 defines central passage 34 enabling rail 3 to pass therethrough and large enough to accommodate an unhindered passing of fishplates 35 connecting two rail sections.

Figure 2:
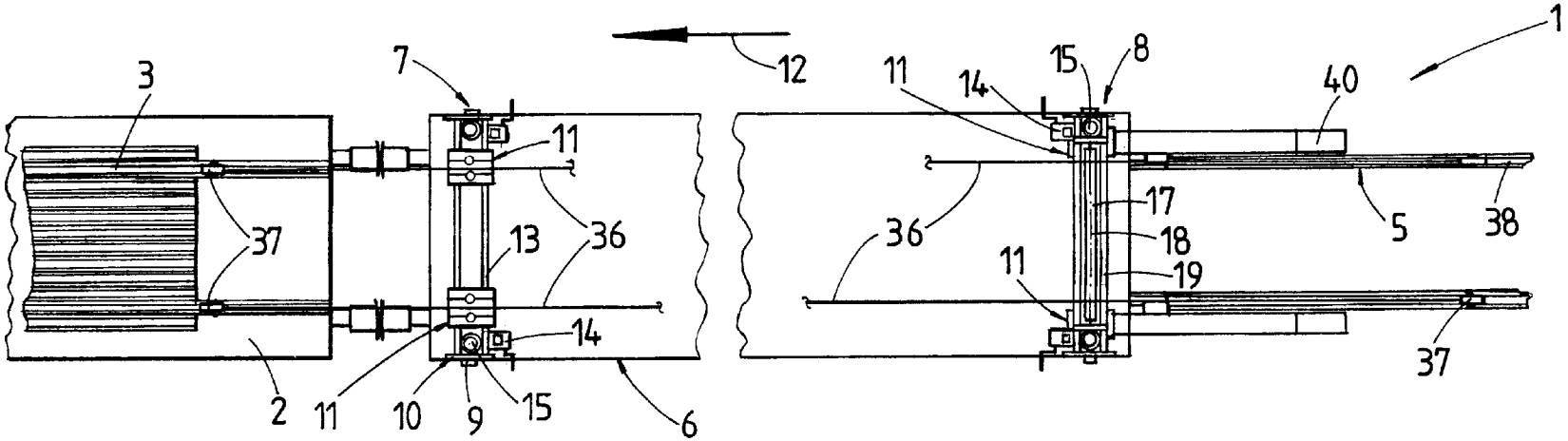
FIG. 2 is a top view of the apparatus of FIG. 1.

Apparatus 1 Operates in the Following Manner:

To pull a pair of rails simultaneously from freight car 2, ropes 36 are fixed by clamping devices 37 to rails 3, on the one hand, and track rails 38, on the other hand, as illustrated in FIGS. 1 and 2, the ropes being guided over rope rolls 17. When freight car 2 and car 6 coupled thereto move forward in the direction of arrow 12, a pulling force is generated to draw the rails in the direction of rail guiding unit 7 closer to freight car 2. Vertically adjusting rail guide heads 11 by operating winches 14 and displacing the rail guide heads transversely will bring the rail guide heads in a suitable position to receive the ends of rails 3. During this initial stage, safety bolts 26 are removed and guide rollers 22 of the rail guide heads are lifted off pins 25 by handles 39 attached to the guide rollers.

Cars 2 and 6 are then advanced again a short distance so that rails 3 are pulled further to rail guide heads 11 of rail guiding unit 7, and the rail guide heads may be further vertically and transversely fine-adjusted to align the rails with passages 34 in carrier bodies 29. Guide rollers 22 are then again mounted on pins 25 and secured against removal by safety bolts 26. The rails are now securely held in rail guide heads 11 against tilting.

Cars 2 and 6 are subsequently advanced again to pull rails 3 further towards rail guiding unit 8. original rope 36 is exchanged for a shorter rope, and suitable vertical adjustment of rope guide roll 17 will enable the ends of the pulled rails to be aligned with passages 34 in the carrier bodies 29 of rail guide heads 11 of rail guiding unit 8. The previously removed guide rollers 22 are then again mounted on their pins and secured thereon with safety bolts 26, as has been explained hereinabove in connection with the operation of rail guiding unit 7. Suitable transverse displacement of the rail guide heads along guide track 33 enables the ends of rails 3 to be so positioned that further pulling of the rails will place them at the desired location of the track.

As soon as the opposite rear ends of rails 3 (not shown) reach front ends of the rails carried on freight car 2, the abutting rail ends are lashed together by fishplates 35. This rail connection is facilitated by a suitable adjustment of rail guide heads 11 of rail guiding unit 7. No rope is required for the further operation since the necessary pulling force is generated by the friction forces of rails 3 lying on the track.

If desired, rail guiding unit 7 arranged at the front end of car 6 in the operating direction could be mounted on the rear end of freight car 2.

Also, instead of mounting rope guide roll 17 on its own vertically adjustable carrier frame 19, the rope guide roll may be mounted directly in carrier body 29 above rail guide rollers 22.

What is claimed is:

1. A mobile apparatus for unloading rails from a freight car on which the rails are arrayed to extend in a longitudinal direction of the freight car, which comprises (a) a track-bound car coupled to the freight car and extending in the longitudinal direction, the track-bound car comprising a flat platform having opposite ends and being supported by undercarriages supporting the car on a track, (b) a rail guiding unit mounted on each one of the platform ends, each rail guiding unit comprising (1) a pair of rail guide heads carried by a common frame mounted on the platform and having guide rollers for centering a respective one of the rails therebetween, (2) the rail guide heads of a first one of the rail guiding units mounted on one of the platform ends being displaceable in a guide track of the common frame extending in a horizontal plane perpendicularly to the longitudinal direction, (c) drives for vertically adjusting the common frame of the rail guide heads of the first rail guiding unit, and (d) a rope guiding roll mounted above at least one of the rail guiding units for guiding a rope having one end attached to each rail to be unloaded and an opposite end affixed to the track.

2. The apparatus of claim 1, wherein the rail guide heads of a second one of the rail guiding units mounted on the opposite platform end are displaceable in a guide track of the common frame extending in a horizontal plane perpendicularly to the longitudinal direction, and comprising means mounted in the guide track for stopping the displacement of the rail guide heads of the second rail guiding unit.

3. The apparatus of claim 1, wherein each rail guiding head comprises a carrier body whereon a pair of said guide rollers is detachably mounted, the guide rollers being rotatable about vertical axes.

4. The apparatus of claim 1, wherein the rope guiding roll is rotatably mounted on a carrier frame extending horizontally and perpendicularly to the longitudinal direction, the carrier frame being mounted on the common frame over the rail guide heads.

5. The apparatus of claim 4, wherein the carrier frame is vertically adjustably mounted on the common frame.

6. The apparatus of claim 1, wherein the common frame comprises a carrier beam extending in the horizontal plane perpendicularly to the longitudinal direction and defining the guide track, and stop means mounted on the carrier beam for stopping the displacement of the rail guide heads.

7. The apparatus of claim 1, further comprising means for detachably mounting the rail guiding units on the car.

* * * * *